United States Patent [19]

Yamada et al.

[11] 4,087,631

[45] May 2, 1978

[54] PROJECTED SOUND LOCALIZATION HEADPHONE APPARATUS

[75] Inventors: Akitoshi Yamada, Daito; Yoichi Kimura, Suita; Yoshinobu Kikuchi, Neyagawa, all of Japan

[73] Assignee: Matsushita Electric Industrial Co., Ltd., Kadoma, Japan

[21] Appl. No.: 659,525

[22] Filed: Feb. 19, 1976

[30] Foreign Application Priority Data

Jul. 16, 1975 Japan ..... 50-87732
Jul. 1, 1975 Japan ..... 50-81696

[51] Int. Cl.[2] ..... H04R 5/00; H04R 3/00

[52] U.S. Cl. ..... 179/1 G; 179/1 GP; 179/1 J

[58] Field of Search ..... 179/1 G, 1 GP, 1 GQ, 179/1 J, 156 R, 100.4 ST, 100.1 TD

[56] References Cited

U.S. PATENT DOCUMENTS

| | | | |
|---|---|---|---|
| 3,088,997 | 5/1963 | Bauer | 179/1 G |
| 3,214,519 | 10/1965 | Fouque | 179/1 G |
| 3,790,711 | 2/1974 | Ojima et al. | 179/1 GP |
| 3,920,904 | 11/1975 | Blauert et al. | 179/1 G |
| 3,924,072 | 12/1975 | Turner et al. | 179/1 G |
| 3,970,787 | 7/1976 | Searle | 179/1 AT |

*Primary Examiner*—Douglas W. Olms
*Attorney, Agent, or Firm*—Stevens, Davis, Miller & Mosher

[57] ABSTRACT

The present invention relates to a headphone apparatus which is adapted to be connected, for headphone listening, to a reproduction apparatus for reproducing a program source such as a record, a magnetic tape or an acoustic apparatus such as a radio receiving set. In accordance with the present invention, there is provided a headphone apparatus in which a direct audio frequency signal as an output signal from the electroacoustic apparatus is applied to reverberation circuits to generate indirect audio frequency signals and these direct and indirect audio frequency signals are mixed and applied to both the left and right electroacoustic transducers of the headphone apparatus, whereby an acoustic image can be established outside the listener's head just as in the case of listening to speakers.

5 Claims, 11 Drawing Figures

( φ = 30° )

PROJECTED SOUND LOCALIZATION HEADPHONE APPARATUS

The present invention relates to a headphone apparatus which is adapted to be connected, for headphone listening, to a reproduction apparatus for reproducing a program source such as a record, a magnetic tape or an acoustic apparatus such as a radio receiving set.

An object of the present invention is to provide a headphone apparatus which makes listening to a headphone resemble listening to a speaker in a room. This effect is made possible merely by connecting a simple electric circuit between the electroacoustic apparatus and the headphone; that is, a sound image can be established outside the head of the listener so that he can continue headphone listening for a long time without fatique.

Another object of the present invention is to provide a headphone apparatus which can be used not only when a program source having two channel stereo signals recorded thereon is reproduced for headphone listening but also when a program source having monaural signals or four channel stereo signals recorded thereon is reproduced for headphone listening.

The above and other features and advantages of the present invention will be apparent from the following detailed description taken in conjunction with the accompanying drawings, in which.

Figure 1:
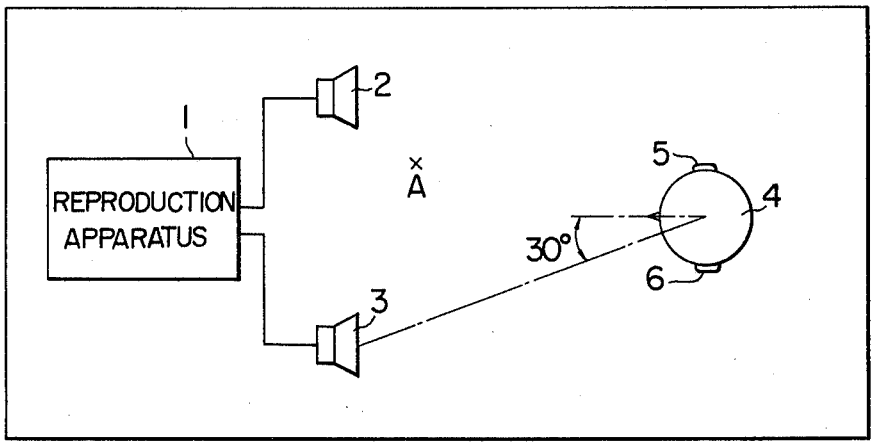
FIG. 1 shows an arrangement for listening to speakers.

FIG. 1 shows an arrangement in which a program source such as a record or a magnetic tape is reproduced for speaker listening in a room. In FIG. 1, 1 designates a reproduction apparatus for reproducing a program source, reference numerals 2 and 3 designate speakers for converting left and right signals reproduced in the reproduction apparatus 1 into acoustic wave, 4 designates a listener, and 5 and 6 designate the ears of the listener 4. The acoustic waves radiated from the speakers 2 and 3 are heard by the ears 5 and 6 of the listener 4, who recognizes a sound image at a point A, for example, outside his head.

Figure 2:
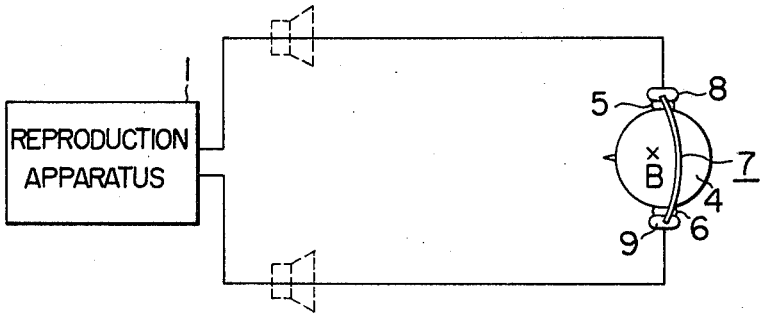
FIG. 2 shows an arrangement for listening through headphones.
Figure 8:
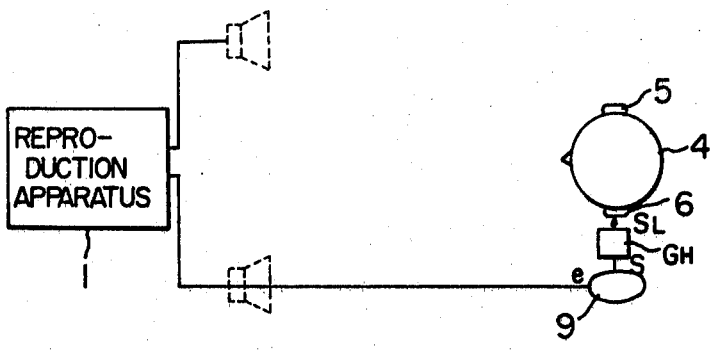
FIG. 8 is a diagram showing a transfer function peculiar to conventional headphone listening.
Figure 9:
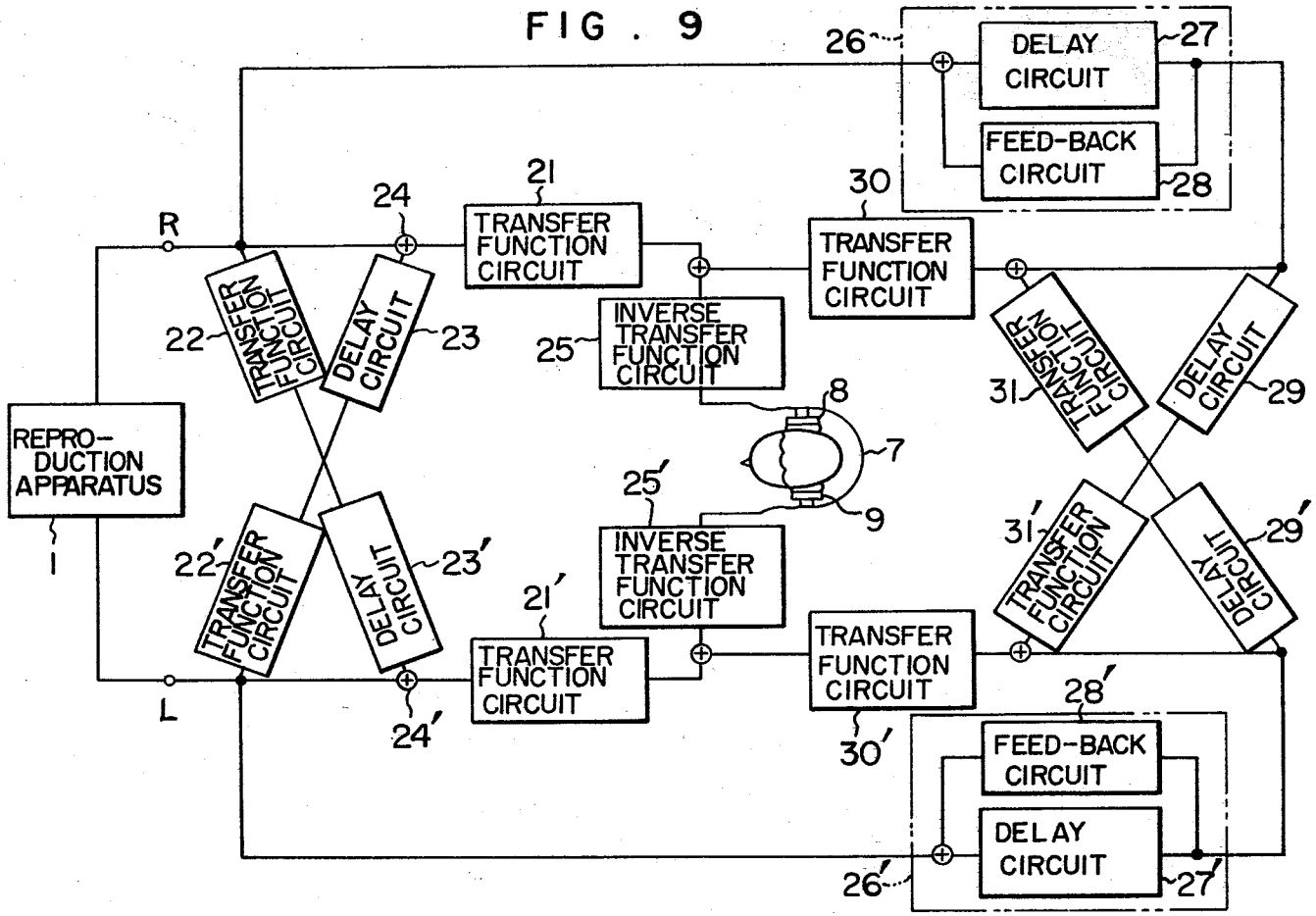
FIGS. 9 and 10 are block diagrams showing still other embodiments of the present invention.

FIG. 2 shows an arrangement wherein the same program source as in FIG. 1 is reproduced by the reproduction apparatus 1 to be heard in a headphone 7. In the case of headphone listening, as shown in FIG. 2, the listener 4 recognizes a sound image at a point B, for example, inside his head. In FIG. 2, 8 and 9 designate electroacoustic transducers disposed on the right and left sides of the headphone 7, respectively.

In accordance with the present invention, there is provided a headphone apparatus in which it is possible in spite of headphone listening to recognize an acoustic image outside the head of the listener 4 just as in speaker listening shown in FIG. 1.

Figure 3:
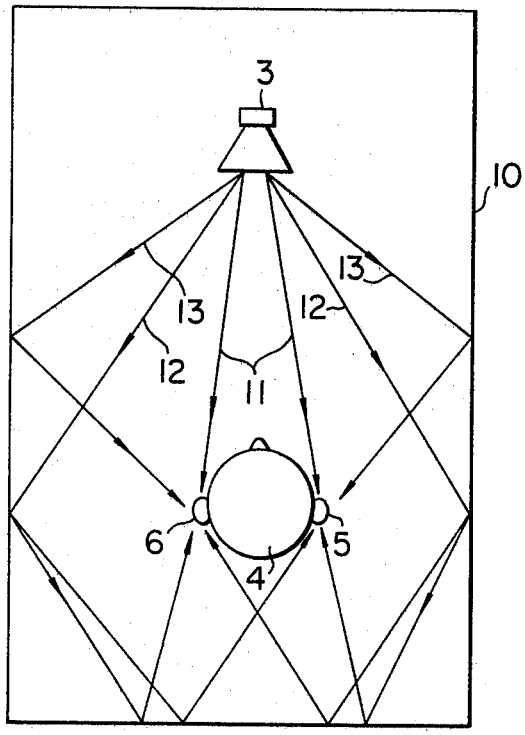
FIG. 3 is a diagram showing paths taken by the sound in the case of speaker listening.

FIG. 3 is a diagram showing speaker listening in a room 10. Sound radiated from the speaker 3 propagates along a number of sound paths (hereinafter referred to as lines of sound) such as lines of sound 11, 12 and 13 to reach the right and left ears 5 and 6 of the listener 4. In this case, the line of sound 11 is the path along which the sound radiated from the speaker 3 can reach the ears 5 and 6 in the shortest time, that is, the path of direct sound, while, the lines of sound 12 and 13 are the paths along which the sound radiated from the speaker 3 reach the ears 5 and 6 after reflection from the walls of the room, for example, that is, the paths of indirect sound. The indirect sound not only reaches the ears 5 and 6 later than the direct sound but also is mostly different in phase between both the left and right ears 5 and 6 because of the phase shift caused by each reflection from the walls and the acoustic asymmetry of the room.

However, in the case of headphone listening as shown in FIG. 2, no indirect sound is included as is the case in speaker listening and an acoustic image is established inside the head.

In accordance with the present invention, in view of the above-mentioned disadvantage, a signal corresponding to the indirect sound in the case of speaker listening (hereinafter referred to as indirect audio frequency signals) is formed to be mixed with another signal corresponding to the direct sound (hereinafter referred to as direct audio frequency signal) and this mixed signal is applied to the headphone so that a sound image can be established outside the head.

Now, the present invention will be described with respect to an embodiment in conjunction with FIG. 4.

Figure 4:
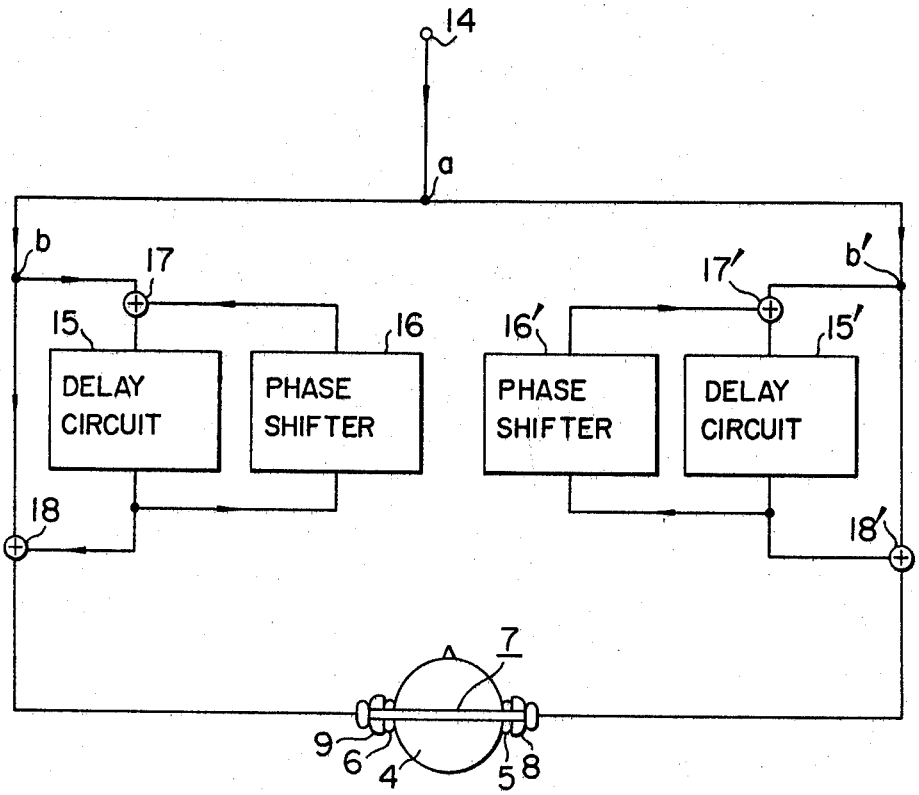
FIG. 4 is a block diagram showing the substantial constituents of an embodiment of a headphone apparatus according to the present invention.

FIG. 4 shows a headphone apparatus according to the present invention in which a program source having monaural signals recorded thereon is reproduced for headphone listening. In FIG. 4, 14 designates an input terminal to which a reproduced monaural signal is applied, 15 and 15′ designate delay circuits, and 16 and 16′ phase shifters having different frequency versus phase characteristics, respectively. The delay circuits 15 and 15′ and the phase shifters 16 and 16′ constitute reverberation generating circuits, respectively. 17 and 17′ designate adders, and reference numerals 18 and 18′ also adders.

As shown in FIG. 4, a signal applied to the input terminal 14 is divided at a point *a* to form two direct audio frequency signal which reach the adders 18 and 18′, respectively. On the other hand, parts of the direct audio frequency signals branch off from points *b*, *b′* through the delay circuits 15 and 15′ to the adders 18 and 18′, respectively, while the outputs of the delay circuits 15 and 15′ are fed back through the phase shifters 16 and 16′ to the adders 17 and 17′, respectively. Thus, the signals resulting from the delay circuits 15 and 15′ and the phase shifters 16 and 16′, respectively, form the signals (indirect audio frequency signals) corresponding to the indirect sound in speaker listening, and each of these indirect audio frequency signals and each of the direct audio frequency signals obtained through the signal paths 14-*a*-*b* and 14-*a*-*b*′ are added respectively at the adders 18 and 18′ to be converted into sound at the electroacoustic transducers 8 and 9 of the headphone 7 and are finally heard at the left and right ears 6 and 5, respectively.

Figure 5:
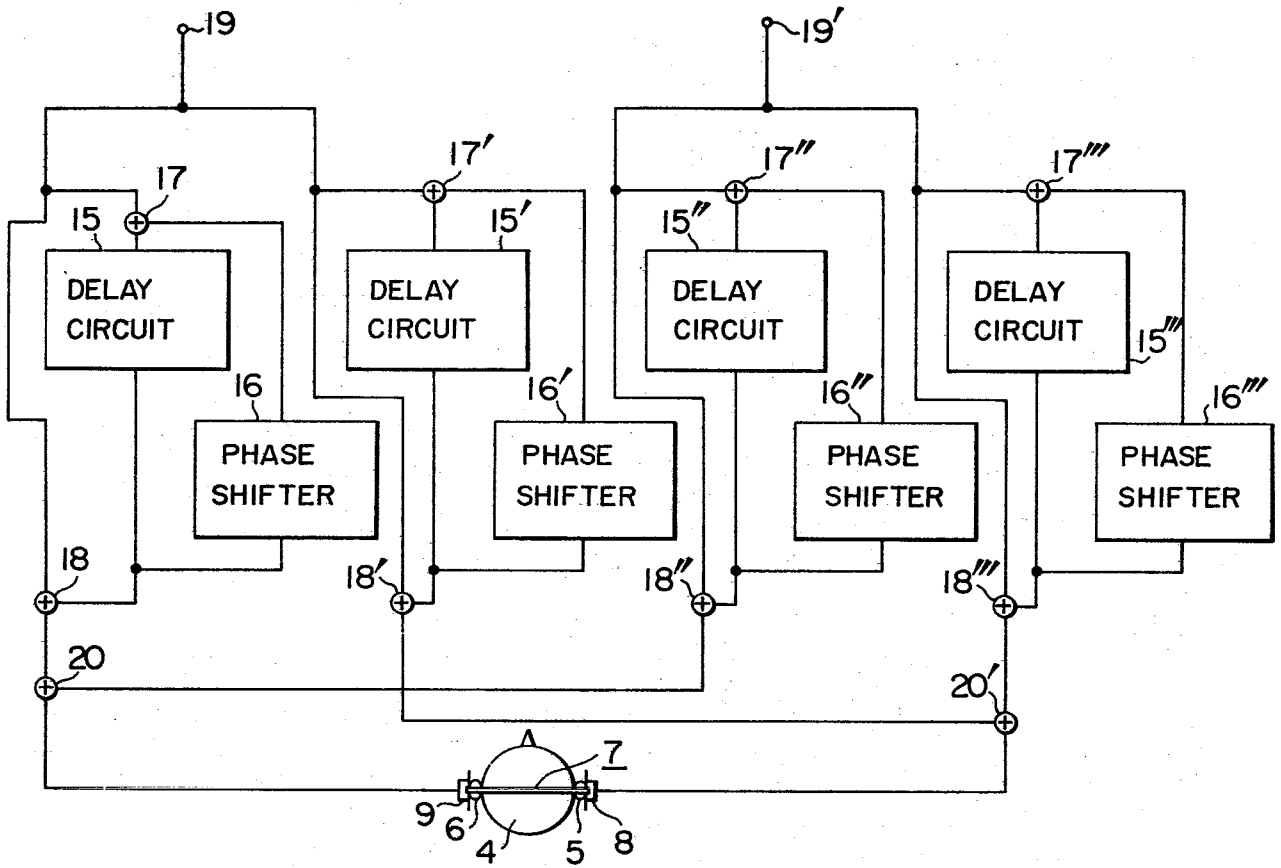
FIG. 5 is a block diagram showing another embodiment of the present invention.

The above-described embodiment is concerned with the case of monaural signals. On the other hand, in the case of two channel stereophonic signals as shown in FIG. 5, each of the left and right signals applied to input terminals 19 and 19′ is divided into two signals, just as in the above-described embodiment, so as to form four indirect audio frequency signals through delay circuits 15, 15′, 15″ and 15‴ and phase shifters 16, 16′, 16″ and 16″′ having different frequency versus phase characteristics, respectively, and these indirect audio frequency signals and signals corresponding to the direct sound are added to be applied to the right and left electroacoustic transducers 8 and 9 of the headphone 7. Further, in FIG. 5, 17, 17′, 17″, 17‴, 18, 18′, 18″, 18‴, 20 and 20′ designate an adder.

The above-described embodiments are ones in which, in paying attention to the significance of indirect sound in speaker listening, the signals corresponding to the indirect sound are introduced for headphone listening. However, in order to simulate speaker listening more accurately, the following points have to be taken into consideration.

Figure 6:
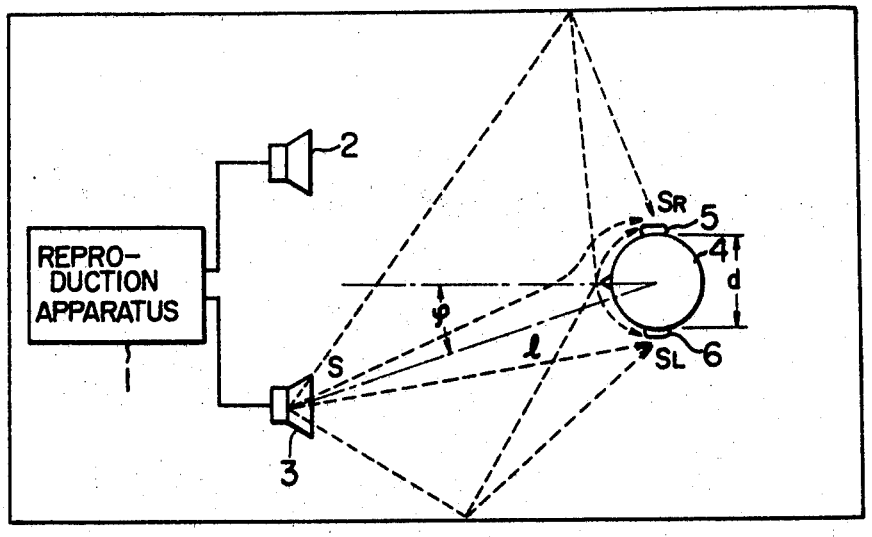
FIG. 6 is a diagram showing paths of sound from the right speaker in FIG. 1 to both the eardrums of a listener.
Figure 7:
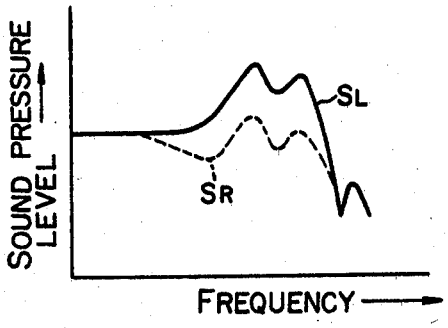
FIG. 7 is a graph showing the sound pressure level characteristics on both eardrums in FIG. 6.

FIG. 6 is a simplified diagram showing the left and right ears 6 and 5 of the listener 4 hearing sound radiated from one of the speakers 3. That is, the sound wave which is radiated from the speaker 3 and has a sound pressure S is led through the auricles to the eardrums of the left and right ears 6 and 5, respectively, and, in this case, the left and right eardrums are given sound pressures $S_L$ and $S_R$, respectively. The sound pressures $S_L$ and $S_R$ are determined by the angle $\phi$ between the front of the listener 4 and the direction of the speaker 3, the distance $l$ between the speaker 3 and the listener 4, the distance $d$ between both the ears and the frequency. The mean value of the distance $d$ is 17 cm. The distance $d$ causes a time delay such that $$\tau = d \sin \phi / c$$

where $c$ represents the sound velocity. FIG. 7 shows the sound pressure level characteristics on the eardrums of the left and right ears 6 and 5 when $\phi = 30°$.

As described above, as far as the direct sound is concerned, the sound pressure versus frequency characteristics on the eardrums of the left and right ears 6 and 5 of the listener 4 are different as shown in FIG. 7, even if sound of sound pressure S is radiated from the same speaker 3, and further the times for the sound radiated from the speaker 3 to reach the left and right ears 6 and 5 are different.

When speaker listening is to be simulated in the case of headphone listening, it has to be noted further that, as shown in FIG. 8, a transfer function $G_H$ which comprises the transfer function of the electroacoustic transducer 9 of the headphone and a transfer function determined by the structure of the listener's ear 6 such as the auricle or the like results from the headphone being put on and, accordingly, it is necessary in headphone listening to compensate for the transfer function $G_H$ resulting from the headphones being put on.

FIG. 9 is a diagram showing the electric circuit of the headphone apparatus of the present invention which is constituted by taking into consideration all the above-mentioned points.

In FIG. 9, 1 designates a reproduction apparatus for reproducing a program source having two channel stereo signals recorded thereon, 7 are headphones, 8 and 9 designate a right transducer and a left transducer respectively of the headphone 7, and the following electric circuit is connected between the reproduction apparatus 1 and the headphone 7. 21 designates an electric circuit which has a transfer function equivalent to the acoustic transfer function between a right speaker and the right eardrum of a listener in the case of speaker listening, 21′ an electric circuit which has a transfer function equivalent to the acoustic transfer function between a left speaker and the left eardrum of the listener in the case of speaker listening, 22 an electric circuit which has a transfer function equivalent to the acoustic transfer function between a right speaker and the left eardrum of the listener in the case of speaker listening, 22′ an electric circuit which has a transfer function equivalent to the acoustic transfer function between a left speaker and the right eardrum of the listener in the case of speaker listening, 23 a delay circuit which causes a time difference equivalent to the time difference between the times for the sound waves radiated from the left speaker to reach the left and right eardrums respectively, 23′ a delay circuit which causes a time difference equivalent to the time difference between the times for the sound wave radiated from the right speaker to reach the left and right eardrums respectively, 24 and 24′ designate adders, and 25 and 25′ electric circuits which each have the inverse function of the acoustic transfer function between the headphone and the left or right eardrums when the headphones are put on.

26 and 26′ designate electric circuits which change signals reproduced in the right and left channels into signals corresponding to the indirect sound, respectively, and these circuits 26 and 26′ are constituted by delay circuits 27 and 27′ and feed-back circuits 28 and 28′ respectively and serve, in particular, to give the reverberation effect. 29 and 29′ designate delay circuits, 30 and 30′ electric circuits which have transfer functions equivalent to the acoustic transfer functions of the acoustic paths from the right and left speakers through reflections from the walls or the like to the right and left ears respectively, and 31 and 31′ electric circuits which have transfer functions equivalent to the acoustic transfer functions of the acoustic paths for indirect sound to be led by diffraction around the head of the listener to the left and right ears, respectively.

Figure 10:
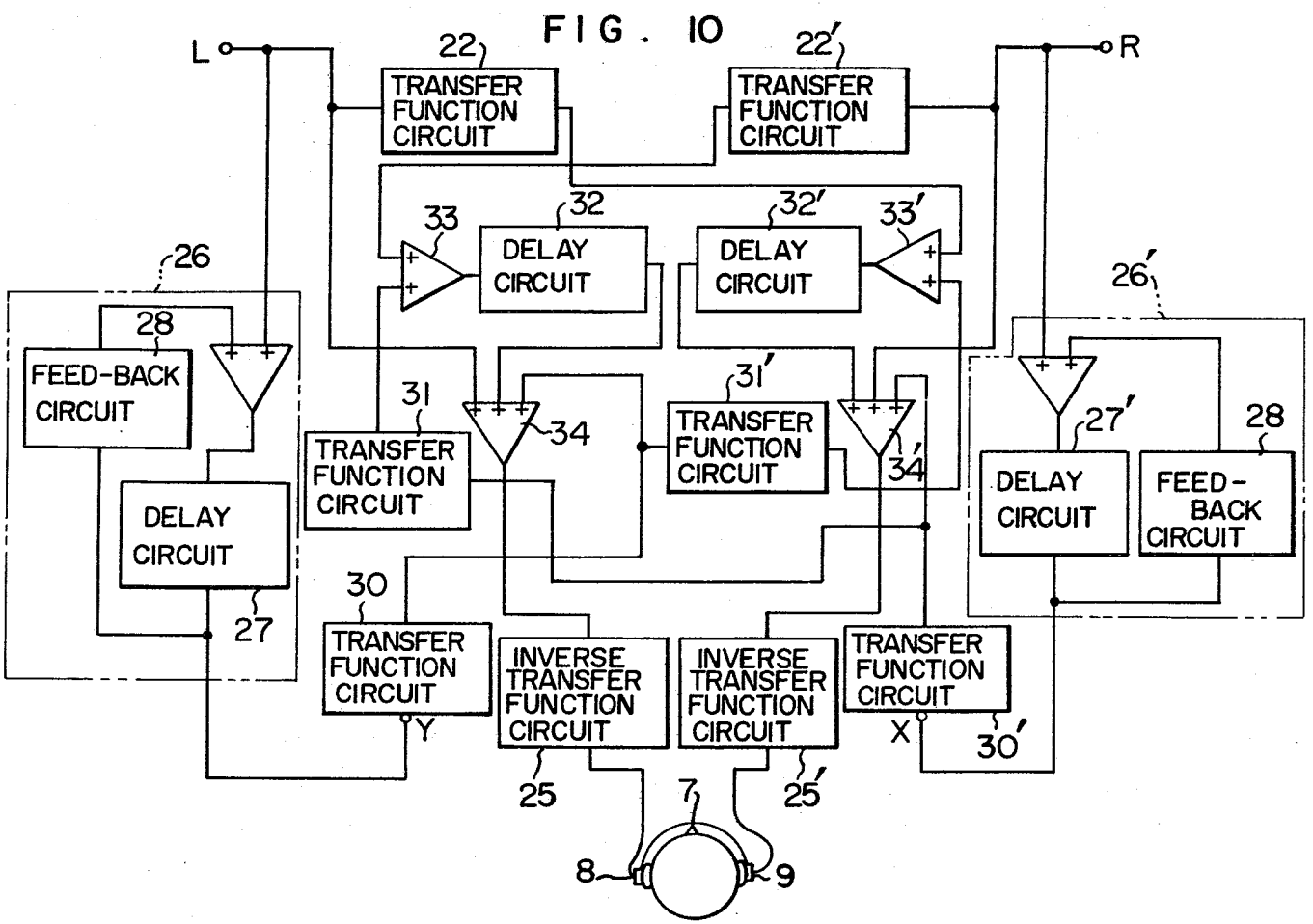

Further, the electric circuits 22, 22′, 31 and 31′ shown in FIGS. 9 and 10 are preferably filters having cut-off frequencies of less than 400 Hz and attenuation characteristics of −1.5 dB/oct. to −6 dB/oct.. The delay time $\tau$ in the delay circuits 23, 23′, 29 and 29′ is determined, by the formula $$\tau = d \sin \phi / c$$

where, as shown in FIG. 6, $c$ cm/sec is the sound velocity, $d$ cm is the distance between the ears of the listener and $\phi$ is the angle between the front direction of the listener and the line connecting the listener and the speaker.

As described above, it is made possible in the embodiment shown in FIG. 9 that, since the acoustic transfer function between the headphones and the eardrums in the ears which result from headphones being put on otherwise as shown in FIG. 8 is compensated for by the circuits 25 and 25' and all the acoustic paths shown in FIG. 6 are simulated by means of electric circuits, the same condition as speaker listening is provided, thus, causing a sound image to be formed outside the head in spite of listening through headphones, and accordingly the fatique peculiar to listening through headphones is avoided even in the case of listening through headphones for a long time.

FIG. 10 shows still another embodiment of the present invention in which the delay circuits 23 and 29 in FIG. 9 are made common by means of a delay circuit 32, and also the delay circuits 23' and 29' are made common by means of a delay circuit 32'. Further, 33, 33', 34 and 34' designate adders.

Figure 11:
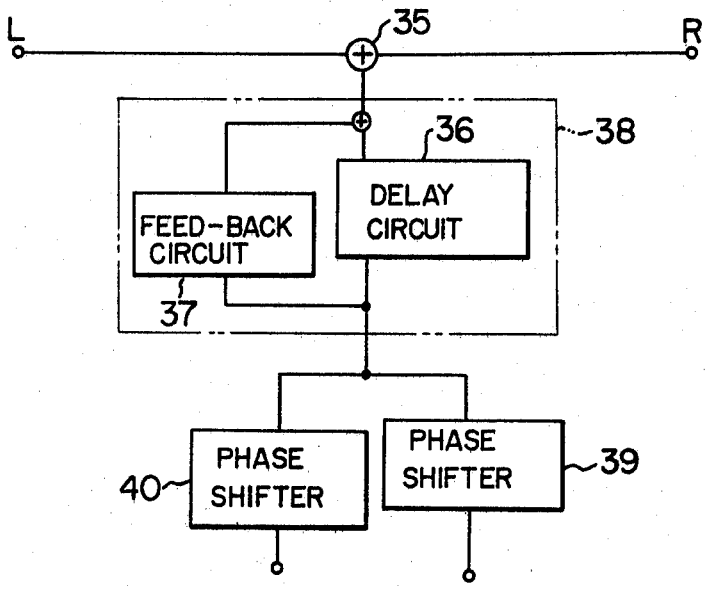
FIG. 11 is a block diagram showing the substantial constituents of still another embodiment of the present invention.

FIG. 11 shows a simplified circuit for simulating indirect sound in which signals in the left and right channels are added in an adder 35 to be changed through a circuit 38 comprising a delay circuit 36 and a feed-back circuit 37 into a signal corresponding to the indirect sound and the resulting signal is applied to phase shifters 39 and 40 which have different characteristics and whose outputs are applied to the terminals X and Y in FIG. 10. The use of the circuit shown in FIG. 11 makes the circuits 26 and 26' in FIG. 10 unnecessary thus causing the whole circuit constitution to be simplified.

What is claimed is:

1. A headphone apparatus comprising a reverberation circuit, a left electroacoustic transducer and a right electroacoustic transducer, wherein two direct audio frequency signals which are output signals of a two channel stereophonic apparatus are mixed with the direct audio frequency signal of another channel, through a filter having a cut-off frequency of less than 400 $H_z$ and an attenuation characteristic of $-1.5$ to $-6$ dB/oct. and a delay circuit, said mixed signal is applied to said reverberation circuit to generate an indirect audio frequency signal, said indirect audio frequency signal is divided into two indirect audio frequency signals, each of said two divided indirect audio frequency signals and each of said two direct audio frequency signals are mixed respectively to generate two mixed signals, and said two mixed signals are applied to said left and right electroacoustic transducers, respectively.

2. A headphone apparatus for receiving an output signal from an electroacoustic apparatus comprising:

first and second electroacoustic transducers coupled to the output of said electroacoustic apparatus, and first and second reverberation circuits coupled to the output of said electroacoustic apparatus and to said first and second electroacoustic transducers respectively, each of said reverberation circuits comprising a phase shifter and a delay circuit coupled thereacross, said delay circuit feeding back the output of said phase shifter to the input thereof, said first and second reverberation circuits generating indirect audio signals which are applied, together with direct audio signals from said electroacoustic apparatus to said first and second electroacoustic transducers, respectively.

3. A headphone apparatus as claimed in claim 2, wherein said electroacoustic apparatus is a monaural apparatus and the monaural signal from said electroacoustic apparatus is applied to said first and second electroacoustic transducers and is also applied to said first and second reverberation circuits.

4. A headphone apparatus as claimed in claim 2, wherein said electroacoustic apparatus is a two channel stereophonic apparatus and further, each of the two direct audio frequency signals outputted from said apparatus are mixed with the direct audio signal of another channel, through a filter having a cut-off frequency of less than 400 $H_z$ and an attentuation characteristic of $-1.5$ to $-6$ dB/oct. and a delay circuit.

5. A headphone apparatus as claimed in claim 2, wherein said electroacoustic apparatus is a two channel stereophonic apparatus and further, third and fourth reverberation circuits are provided, and each of the two direct audio frequency signals outputted from said apparatus and each of the indirect audio frequency signals obtained by passing the direct audio frequency signals through said third and fourth reverberation circuits respectively are mixed with a signal obtained by mixing direct and indirect audio signals of another channel.

* * * * *